United States Patent [19]

Knapp

[11] Patent Number: 4,585,174

[45] Date of Patent: Apr. 29, 1986

[54] ELECTRO-MAGNETICALLY OPERABLE VALVE

[75] Inventor: Heinrich Knapp, Leonberg, Fed. Rep. of Germany

[73] Assignee: Robert Bosch GmbH, Stuttgart, Fed. Rep. of Germany

[21] Appl. No.: 584,353

[22] Filed: Feb. 28, 1984

[30] Foreign Application Priority Data

Apr. 2, 1983 [DE] Fed. Rep. of Germany ..... 3312067

[51] Int. Cl.[4] ..... F02M 47/02

[52] U.S. Cl. ..... 239/533.8; 239/585; 239/533.9; 239/533.11; 251/129.2

[58] Field of Search ..... 239/533.3–533.12, 239/585; 251/138–141; 123/472

[56] References Cited

U.S. PATENT DOCUMENTS 3,737,880 5/1973 Williams ..... 239/585

4,434,765 3/1984 Eshelman ..... 239/585

FOREIGN PATENT DOCUMENTS 2033004 5/1980 United Kingdom ..... 239/585

*Primary Examiner*—Jeffrey V. Nase

*Assistant Examiner*—Scott Malpede

*Attorney, Agent, or Firm*—Edwin E. Greigg

[57] ABSTRACT

An electro-magnetically operable valve serving especially as fuel injection valve for a fuel injection device of internal combustion engines. The valve is composed of a valve housing, in which a magnetic coil is disposed around a core. The core has a concavely formed stop face against which, during excitation of the magnetic coil, a ball rests. The ball serves as an armature and movable valve part and cooperates with a fixed valve seat. The radius ($r_1$) of the concavely formed stop face of the core is larger by about 0.1 to 1 mm than the radius ($r_2$) of the ball. This causes a sufficient hydraulic cushion between the end face of the core and the ball when the ball is attracted toward the core upon magnetic energization of the latter and thus prevents a bouncing movement of the ball or its sticking to the core, when the ball is biased toward the valve seat upon de-energization of the core.

1 Claim, 1 Drawing Figure

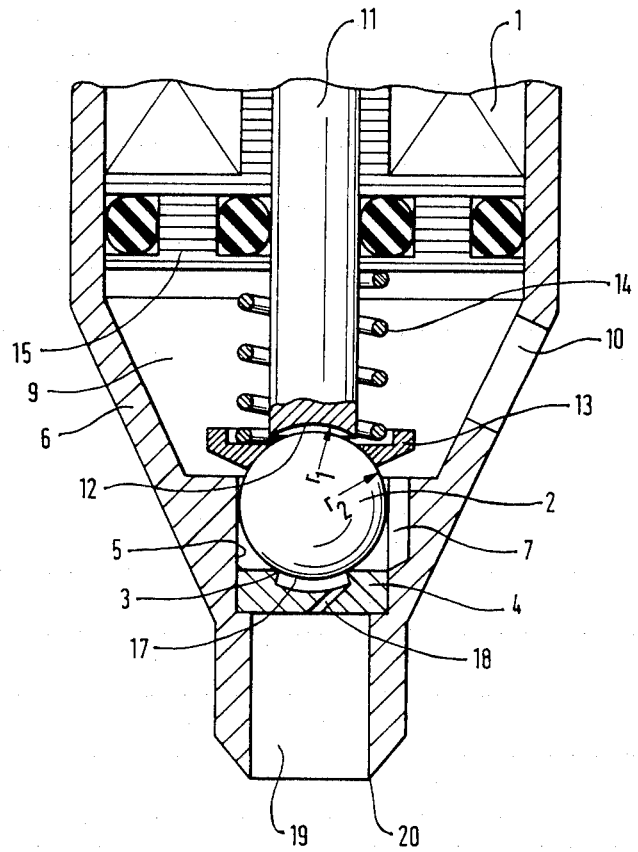
11
1
14
15
10
9
13
6
12
2
5
7
3
4
17
18
19
20

ELECTRO-MAGNETICALLY OPERABLE VALVE

BACKGROUND OF THE INVENTION

The invention is based on an electro-magnetically operable valve for a fuel injection device for internal combustion engines. A valve is already known wherein a stop face provided on the magnet core has the same radius as an attracted ball which serves as part of the valve and as an armature. This causes an undesirable slowing of the closing movement of the ball, the latter having a tendency to stick to the core after the end of the excitation of the magnetic coil. This leads to an undesirable effect on the amount of medium to be controlled.

OBJECT AND SUMMARY OF THE INVENTION

In contrast to the foregoing, the valve in accordance with the present invention has the advantage that sticking of the valve ball to the core at the de-energization of the magnetic coil is avoided. This is in addition to a desired hydraulic damping of the valve ball in its motion towards the core which damping is important to avoid bouncing of the ball against the stop face during the attraction move of the valve ball.

The invention will be better understood and further objects and advantages thereof will become more apparent from the ensuing detailed description of a preferred embodiment taken in conjunction with the drawing.

BRIEF DESCRIPTION OF THE DRAWING

An exemplary embodiment of the present invention is shown in simplified form in the drawing and is further described in the ensuing description.

DESCRIPTION OF THE PREFERRED EMBODIMENT

The fuel injection valve, shown in the drawing in partial view, is electro-magnetically operable in a known manner by means of excitation of a magnetic coil 1. It serves, for example, as part of a fuel injection device for the injection of fuel, especially at low pressure, into the air intake tube of mixture-compressing external-ignition internal combustion engines. The fuel injection valve has a ball 2 in the form of a movable valve part that is made from a soft magnetic material. The ball cooperates with a fixed valve seat 3, which is embodied in a valve seat body 4 made from an especially hard, non-magnetic material. The valve seat body 4 is inserted in a guide bore 5 of the valve housing 6. The guide bore 5 also serves to radially guide the ball 2 and has grooves 7 extending in an axial direction. The grooves 7 communicate with a spring chamber 9 upstream from the valve seat 3. The spring chamber 9 is connected with a fuel supply line, not shown, by way of a fuel flow opening 10 in the valve housing 6. A core 11, made from a ferro-magnetic material is partially surrounded by the magnetic coil 1 and has a concavely formed stop face 12 facing the ball 2. The ball 2 is also designed to function as an armature. The core 11 extends into the spring chamber 9 with its end face facing the valve seat 3. A spring plate 13 is supported on the ball 2, the latter partially extending into the spring chamber 9. The spring plate is engaged by a spring 14, urging on the one side the ball towards the valve seat 3 and resting, on the other side, against a sealing body 15.

The ball 2 and the stop face 12 of the core 11 can be covered electrolytically with a hard, preferably non-magnetic thin layer of, for instance, nickel, in order to obtain a harder surface.

The radius $r_1$ of the concavely formed stop face 12 of the core 11 should be approximately 0.1 to 1 mm larger than the radius $r_2$ of the ball 2. Because of this, during excitation of the magnetic coil, the ball 2 is hydraulically cushioned by the fuel displaced between the ball 2 and the stop face 12 to the extent that a bouncing movement of the ball is effectively prevented. On the other hand, when the magnetic coil 1 is de-energized, no sticking of the ball 2 to the stop face 12 occurs and the ball 2 is moved by the spring 14 at sufficient speed in the direction of closing of the valve toward the valve seat 3.

Fuel, flowing by way of the grooves 7, flows past the valve seat 3 into a collecting chamber 17 when the ball 2 is raised from the valve seat 3. Swirl conduits 18, open in the direction of the collecting chamber 17, branch off the latter. The swirl conduits, in a known manner, preferably are tilted at an angle to the valve axis and discharge into a swirl chamber 19. The fuel stream enters over the sharp edge 20 of the swirl chamber into the air intake tube of the internal combustion engine in the form of a film.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electro-magnetically operable fuel injection valve for a fuel injection device of an internal combustion engine, said injection valve having a valve housing, a guide bore, a fixed valve seat in said guide bore, a core of ferro-magnetic material and a ball, said ball cooperating as a movable valve part with said fixed valve seat, said guide bore forming a guide for said ball, said ball being of a soft magnetic material and, during excitation of the magnetic core, being moved away from the valve seat and against a concavely formed stop face of the core, and the radius ($r_1$) of the concavely formed stop face of the core being larger by about 0.1 to 1 mm than the radius ($r_2$) of the ball.

* * * * *